United States Patent [19]

Yamakami et al.

[11] 4,142,982

[45] Mar. 6, 1979

[54] TONER FOR DEVELOPING ELECTROSTATIC LATENT IMAGES COMPRISING RESIN BINDER OF POLYESTER AND SOLID SILICONE VARNISH

[75] Inventors: Hiroshi Yamakami, Tokyo; Yasuo Mitsuhashi, Yokohama; Seiji Tomari, Toride; Kaichi Tsuchiya, Fuchu, all of Japan

[73] Assignee: Canon Kabushiki Kaisha, Tokyo, Japan

[21] Appl. No.: 689,990

[22] Filed: May 26, 1976

[30] Foreign Application Priority Data

| | | | |
|---|---|---|---|
| Jun. 4, 1975 | [JP] | Japan | 50-67329 |
| Jun. 6, 1975 | [JP] | Japan | 50-68256 |
| Jun. 6, 1975 | [JP] | Japan | 50-68761 |
| Jun. 6, 1975 | [JP] | Japan | 50-68762 |

[51] Int. Cl.[2] ..... G03G 9/08

[52] U.S. Cl. ..... 252/62.1 P; 8/4; 96/1 SD; 96/1.2; 252/62.1 R; 260/824 R

[58] Field of Search ..... 252/62.1 P, 62.1 L, 252/62.1 R; 260/824 R; 96/1 SD, 1.2; 8/4

[56] References Cited

U.S. PATENT DOCUMENTS

| | | | |
|---|---|---|---|
| 3,041,169 | 6/1962 | Wielicki | 252/62.1 P |
| 3,105,821 | 10/1963 | Johnson | 252/62.1 L |
| 3,338,991 | 8/1967 | Insalaco et al. | 252/62.1 P |
| 3,553,133 | 1/1971 | Olson | 260/824 R |
| 3,579,522 | 5/1971 | Bendszus et al. | 260/824 R |
| 3,799,773 | 3/1974 | Watarai et al. | 252/62.1 P |
| 3,819,367 | 6/1974 | Chatterji | 252/62.1 P |
| 3,852,065 | 12/1974 | Hectors | 252/62.1 |
| 3,909,259 | 9/1975 | Mammino et al. | 252/62.1 P |
| 3,959,404 | 5/1976 | Labana et al. | 252/62.1 P |
| 3,965,022 | 6/1976 | Strong et al. | 252/62.1 P |
| 3,998,747 | 12/1976 | Yamakami et al. | 252/62.1 P |

*Primary Examiner*—John D. Smith

*Attorney, Agent, or Firm*—Fitzpatrick, Cella, Harper & Scinto

[57] ABSTRACT

A toner for developing electrostatic latent images contains a resin binder mainly composed of a polyester resin having a softening point of 80–150° C. according to the Ring and Ball method and a solid silicone varnish having a molecular weight of 500–2000.

19 Claims, No Drawings

TONER FOR DEVELOPING ELECTROSTATIC LATENT IMAGES COMPRISING RESIN BINDER OF POLYESTER AND SOLID SILICONE VARNISH

BACKGROUND OF THE INVENTION

1. Field of the Invention

This invention relates to a toner for developing electrostatic images, and more particularly, to color toners such as magenta, cyan, and yellow toners for developing electrostatic images.

2. Description of the Prior Art

Heretofore, various electrophotographic methods have been known. For example, U.S. Pat. No. 2,297,691, Japanese Patent Publication Nos. 23910/1967 and 24748/1968 disclose electrophotographic methods. In general, these electrophotographic methods utilize photoconductive materials as the photosensitive material and comprise charging, imagewise exposing to form electric latent images on a photosensitive member, developing the latent images with a toner, and if desired, transferring the developed images to a web such as paper and fixed by, for example, heating, pressing or applying a solvent vapor. When multi-color images are desired, the original light image is projected to a photosensitive member through a color separation filter, and the above mentioned procedure is repeated by using various filters and the corresponding color toners such as yellow, magenta and cyan toners, and the toners are overlaid subsequently to produce a color image.

There are known toners composed of coloring materials such as carbon black, metal-containing dyes, pigments and the like dispersed in resin binders such as polystyrene and ground to fine powders of 1–50 microns in size. These toners are usually mixed with carriers such as glass beads, iron powders, fur and the like, for developing electric latent images. These toners are requested to have particular chemical and physical properties desirable for electrophotography and other practical purposes.

However, conventional toners often have the following drawbacks. Most toners capable of being easily melted by heating are apt to agglomerate during storage and upon handling. Most toners are adversely affected by changes in ambient humidity and thereby the triboelectric characteristics and fluidity characteristics are degraded. When conventional toners are used, the toner, a carrier and the surface of a photosensitive plate are all deteriorated by collision between the toner particles and the carrier and contact of the toner particles with the surface of the photosensitive plate as the result of repeated and continuous use of the toner. Therefore, the resulting image density is not constant, but changes, and the background density increases to deteriorate the image quality.

When it is tried to increase the image density by increasing the toner amount to be attached to the surface of a photosensitive plate, the background density also increases and fog is formed in most cases of conventional toners.

In case of color electrophotography according to a multi-color overlaying process, the color toner should have the following particular characteristics as well as excellent physical and chemical properties overcoming the above mentioned drawbacks.

(1) The toners should have a high transparency because different color toners are to be overlaid.

(2) The toners should be melt-miscible.

(3) Spectral reflection characteristic should be excellent so as to reproduce the original with high fidelity.

In addition, it is very difficult to use a charge control agent for imparting a desirable polarity of triboelectric charge to a toner in the case of a color electrophotographic toner. Therefore, it is necessary that a toner can be selectively charged negatively or positively as to a certain carrier to be used together by selecting appropriately only a colorant and a resin binder. In general, color electrophotographic toners must satisfy various conditions and therefore, it is not easy to satisfy simultaneously such various conditions as well as conditions to obtain a desirable polarity of the toner by selecting only a combination of a colorant and a resin binder. In view of the foregoing, the combination of the colorant and the resin binder is very important and the desirable combination is not easily anticipated by prior art.

SUMMARY OF THE INVENTION

An object of the present invention is to provide a toner capable of being fixed rapidly by a low heat energy.

Another object of the present invention is to provide a toner which hardly agglomerates during storage and handling.

A further object of the present invention is to provide a toner having stable fluidity characteristics and triboelectric characteristics even under variable humidity conditions.

Still another object of the present invention is to provide a toner capable of giving a constant image density in a continuous copying where development is repeated many times, and capable of preventing degradation of image quality in such continuous copying.

A still further object of the present invention is to provide a toner of excellent spectral reflection characteristics and high transparency suitable for color electrophotography.

Still another object of the present invention is to provide a toner for electrophotography and electrostatic printing.

A still further object of the present invention is to provide a resin binder for a toner.

According to the present invention there is provided a toner for developing electrostatic latent images which contains a resin binder mainly composed of a polyester resin having a softening point of 80–150° C. according to the Ring and Ball method and a solid silicone varnish having a molecular weight of 500–2000.

DESCRIPTION OF THE PREFERRED EMBODIMENTS

The polyester resin has a softening point of 80–150° C., preferably 90–110° C. The softening point is measured by the Ring and Ball method according to JIS K 2406 (similar to STPTC PT 3–50 in Britain, ASTM E 28-42 T in U.S.A. and DIN 1999 in Germany).

The polyester resin may be prepared from a diol and a dicarboxylic acid or their derivatives.

Representative diols are ethylene glycol, 1,2-propylene glycol, 1,3-propylene glycol, 1,4-butanediol, neopentyl glycol, 1,4-butenediol, 1,4-bis(hydroxymethyl)-cyclohexane, bisphenol A, hydrogenated bisphenol A, polyoxyethylenated bisphenol A and the like.

Representative dicarboxylic acids and their derivatives are maleic acid, fumaric acid, isophthalic acid, terephthalic acid, cyclohexane dicarboxylic acid, succinic acid, adipic acid, sebacic acid, malonic acid, oxalic acid, their anhydrides, their esters with lower alcohols, and the like.

Typical examples of the polyester resin are as shown below.

| | |
|---|---|
| (1) Polyester Resin (A) | |
| Produced by reacting the following components. | |
| Bisphenol A | 2.0 moles |
| Fumaric acid | 2.0 moles |
| (Softening point 140° C) | |
| (2) Polyester Resin (B) | |
| Produced by reacting the following components. | |
| Propylene glycol | 5.25 moles |
| Fumaric acid | 5.00 moles |
| (Softening point 113° C) | |
| (3) Polyester Resin (C) | |
| Produced by reacting the following components. | |
| Neopentyl glycol | 5.00 moles |
| Fumaric acid | 5.00 moles |
| (Softening point 96° C) | |
| (4) Polyester Resin (D) | |
| Propylene glycol | 5.25 moles |
| Maleic anhydride | 2.5 moles |
| Phthalic anhydride | 2.5 moles |
| (Softening point 110° C) | |
| (5) Polyester Resin (E) | |
| Propylene glycol | 5.25 moles |
| Maleic anhydride | 5.00 moles |
| (Softening point 92° C) | |
| (6) Polyester Resin (F) | |
| Neopentyl glycol | 7.35 moles |
| Fumaric acid | 7.00 moles |
| (Softening point 88° C) | |
| (7) Polyester Resin (G) | |
| Propylene glycol | 2.0 moles |
| Neopentyl glycol | 3.15 moles |
| Fumaric acid | 5.00 moles |
| (Softening point 98° C) | |
| (8) Polyester Resin (H) | |
| Propylene glycol | 2.1 moles |
| Neopentyl glycol | 3.15 moles |
| Fumaric acid | 3.32 moles |
| Phthalic anhydride | 1.68 moles |
| (Softening point 98° C) | |

Representative silicone varnishes having a molecular weight of 500–2000 may be methyl silicone varnish mainly prepared by hydrolyzing monomethyl trichlorosilane followed by polycondensation, phenyl silicone varnish mainly prepared from monophenyl trichlorosilane, methyl phenyl silicone varnish mainly prepared from monophenyl trichlorosilane and monomethyl trichlorosilane, and the like.

The silicone varnishes have a softening point of 55–150° C., preferably 60–110° C.

According to the present invention, the solid silicone varnish is used in an amount of at least one part by weight, preferably about 2–100 parts by weight and more preferably about 4–100 parts by weight per 100 parts by weight of the polyester resin. Adding more than 100 parts by weight of the solid silicone varnish to 100 parts by weight of the polyester resin is not economical because solid silicone varnishes are expensive.

The resin binder comprising the polyester resin and the solid silicone varnish according to the present invention has excellent pulverizing property and transparency, can prevent agglomeration of the resulting toner and furthermore, the resulting toner shows only little change of fluidity caused by humidity and of triboelectric property. In addition, the resulting toner has a high durability when used continuously.

The resin binder according to the present invention may additionally contain other binding resins or additives. The toner according to the present invention may be prepared by adding about 1–20 parts by weight of a colorant such as dyes and pigments to 100 parts by weight of the resin binder and pulverizing the resulting mixture to produce finely divided powders of about 1–50 microns in size by a conventional method.

The toners may be mixed with iron powders, glass beads or the like, or used together with a fur brush for electrophotographic development of the dry type.

As the colorant in the toner of the present invention, there may be used various dyes and pigments which can be used for conventional electrophotographic toners. For example, there may be mentioned carbon black (C.I. 77266), nigrosine (C.I. 50415), iron oxide black, metal complex salt dyes, chrome yellow (C.I. 14095, C.I. 14025) Hansa yellow (C.I. 11680, C.I. 11710), benzidine yellow (C.I. 21090, C.I. 21095, C.I. 21100), red iron oxide, quinacridone pigment (C.I. Pigment Red 122), rhodamine pigment (C.I. Pigment Red 81), aniline red, Brilliant Carmine 6B (C.I. 15850), prussian blue, ultramarine, phthalocyanine blue (C.I. 74160, C.I. 74180, C.I. 74100) and the like.

When color toners such as yellow, magenta and cyan toners are prepared by using the resin binder mainly composed of the polyester resin and the solid silicone varnish, it is preferable to combine the resin binder with the following dyes.

For preparing yellow toners, benzidine yellow organic pigments (3,3'-dichlorobenzidine derivatives) are preferable. Representative benzidine yellow organic pigments are Color Index No. 21090 (for example, commercially available Pigment Yellow 12 and Symuler Fast Yellow GF), Color Index 21095 (for example, commercially available Pigment Yellow 14, Benzidine Yellow G, Benzidine Yellow I.G., Vulcan Fast Yellow G, Benzidine Yellow OT, and Symuler Fast Yellow 5GF, and Color Index 21100 (for example, commercially available Pigment Yellow 13, Benzidine Yellow GR, Permanent Yellow GR, and Symuler Fast Yellow GRF).

For preparing magenta toners, magenta organic pigments of quinacridone series and magenta organic pigments of rhodamine series are preferably used. Representative magenta organic pigments are Pigment Red C.I. 122 (for example, commercially available Permanent Pink E and Fastgen Super Magenta RS) and Pigment Red C.I. 81 (for example, commercially available Seikalight Rose 81, Symlex Rhodamine Y, and Irgalite Brillred TCR).

For preparing cyan toners, phthalocyanine blue organic pigments are preferably used. The representative ones are Color Index Nos. 74100, 74250, 74260, 74280, 74255, 74160, 74180 and the like which are commercially available.

Color toners according to the present invention comprising a resin binder mainly composed of a polyester resin and a solid silicone varnish and the above mentioned yellow, magenta or cyan dye, have excellent triboelectric characteristics and spectral reflection characteristics and a very low degree of agglomeration. An image formed by overlaying yellow, magenta and cyan color toners shows a strong black color.

In case of producing color toners, the ratio of the dye to the resin binder is important. For yellow toners, usually 2–15 parts by weight, preferably 3–10 parts of a yellow dye is used per 100 parts by weight of the resin binder. For magenta toners, usually 2–10 parts by weight, preferably 2.5–7 parts by weight of a magenta dye is used per 100 parts by weight of the resin binder. For cyan toners, usually 1–10 parts by weight, preferably 2–7 parts by weight is used per 100 parts by weight of the resin binder.

As mentioned previously, when resin binders having a low softening point are used, the resulting toners are apt to agglomerate, and this tendency of agglomeration is remarkable when the softening point of the toner is not higher than 100° C. This is the case when toners contain only a polyester resin as the resin binder. However, the toner according to the present invention using a resin binder composed mainly of the polyester resin and the solid silicone varnish shows a very little agglomeration and an excellent fluidity.

In other words, the toner containing the resin binder according to the present invention has a desirable triboelectric property and fluidity and can be sufficiently melted and fixed by only a low heat energy, and there occurs almost no agglomeration of the toner.

An example of particularly preferable resin binders of the present invention is composed of a polyester resin having a softening of 90–110° C. produced from bisphenol A or substituted bisphenol A and a low molecular weight dicarboxylic acid such as fumaric acid and the like and a solid silicone varnish of a molecular weight of 500–2000. A toner obtained by dispersing an appropriate dye or pigment in the resin binder has more stable triboelectric characteristics and better fluidity than conventional toners.

The following examples are given for illustrating the present invention, but not for limiting the present invention. In the following examples, parts are by weight unless otherwise specified.

EXAMPLE 1

350 parts of polyester resin (derived from bisphenol A and fumaric acid) (XPL 2005S, trade name, manufactured by Kao Atlas Co.), 50 parts of solid methyl silicone varnish (KR 220, trade name, produced by Shinetsu Kagaku), 24 parts of carbon black and 8 parts of metal-containing dye (Spilon Black BHH, trade name, produced by Hodogaya Kagaku) were mixed and ground by a ball-mill, melted and kneaded by a roll-mill, cooled, roughly ground by a speed mill and then finely pulverized by a pulverizer of an air-jet type. The resulting finely divided powders were classified to select powders of particle size of 3–20 microns, which were used for a toner.

13 parts of the toner and 87 parts of a carrier iron powder (EF 200/300, trade name, Nihon Teppun) were mixed to obtain a developer.

The developer was used for copying by a dry type electrophotographic copier using an ordinary paper (NP 1000, trade name, manufactured by Canon Kabushiki Kaisha) and there were obtained sharp black images free from fog. Even after producing continuously 30,000 sheets of copy, the further copy was good and no degradation of image quality was observed.

The toner was excellent in fluidity and there was not observed any deterioration of various characteristics.

EXAMPLE 2

Repeating the procedure of Example 1 except that 375 parts of the polyester resin and 25 parts of the solid silicone were used in place of those in Example 1, the result was almost similar to that in Example 1.

EXAMPLE 3

Repeating the procedure of Example 1 except that the polyester resin was used in an amount of 200 parts instead of 350 parts and the solid methyl silicone varnish was used in an amount of 200 parts instead of 50 parts and the metal-containing dye was not used, the result was almost similar to that of Example 1.

EXAMPLE 4

350 parts of polyester resin (G 6570, trade name, manufactured by Kao Atlas Co.), 50 parts of solid silicone varnish (KR 220, trade name, produced by Shinetsu Kagaku), and 32 parts of carbon black were used to produce a toner and copying was effected in a similar way to Example 1. The result was almost the same as that in Example 1.

EXAMPLE 5

350 parts of polyester resin (XPL 2005S, trade name), 50 parts of solid silicone varnish (KR 216, trade name, produced by Shinetsu Kagaku), 24 parts of carbon black and 8 parts of Spilon Black BHH (trade name) were used to produce a toner and copying was conducted in a way similar to Example 1. The result was almost similar to that of Example 1 except that the fluidity was somewhat low.

EXAMPLE 6

350 parts of polyester resin (XPL 2005S, trade name), 50 parts of solid silicone varnish (KR 220, trade name), and 8 parts of carbon black were made into a toner and used for copying in a way similar to Example 1. The result was almost similar to that in Example 1.

EXAMPLE 7

In the procedure of Example 6, the carbon black was used in an amount of 40 parts instead of 8 parts and the result was similar to that in Example 6.

EXAMPLE 8

In the procedure of Example 6, the carbon black was used in an amount of 60 parts instead of 8 parts, and a result almost similar to that in Example 6 was obtained.

EXAMPLE 9

Repeating the procedure of Example 1 except that each of polyester resins (B)–(H) as mentioned above was used in place of the polyester resin, XPL 2005S, there was obtained a result almost similar to that in Example 1.

EXAMPLE 10

Repeating the procedure of Example 1 except that solid phenyl silicone varnish or solid methyl phenyl silicone varnish was employed in place of the solid methyl silicone varnish, a result similar to Example 1 was obtained.

COMPARATIVE EXAMPLE 1

400 parts of polyester resin (XPL 2005S, trade name), 24 parts of carbon black (Regal 400R, trade name) and 8 parts of metal-containing dye (Spilon Black BHH, trade name) were made into a toner in a way similar to Example 1. When 10,000 sheets of copy were continuously produced, the copy quality was remarkably deteriorated and the degree of agglomeration of the toner was large.

COMPARATIVE EXAMPLE 2

400 parts of polyester resin (G 6570, trade name) and 24 parts of carbon black were made into a toner in a way similar to Example 1.

When 7000 sheets of copy were continuously made, the image quality was lowered remarkably, and the degree of agglomeration of the toner was high.

Triboelectric charge (μc/g) and degree of agglomeration in some of the above Examples and Comparative Examples are shown in Table 1 below, and the change of triboelectric charge and image density as the copying continuously proceeds in Example 1 and Comparative Example 1 are listed in Table 2 below.

Table 1

| | Triboelectric charge (μc/g) | Degree of agglomeration |
|---|---|---|
| Example 1 | −3.92 | 23.4 |
| 2 | −3.51 | 33.6 |
| 3 | −4.70 | 20.1 |
| 4 | −4.93 | 22.1 |
| 5 | −2.94 | 44.5 |
| 6 | −5.57 | 25.2 |
| 7 | −4.68 | 22.1 |
| 8 | −2.86 | 21.7 |
| Comparative Example 1 | −3.77 | 82.9 |
| 2 | −5.01 | 77.3 |

Table 2

| Sheets of Copy | Example 1 | | Comparative Example 1 | |
|---|---|---|---|---|
| | Triboelectric charge μc/g | Image density | Triboelectric charge μc/g | Image density |
| 0 | −3.92 | 1.70 | −3.77 | 1.63 |
| 2000 | −4.33 | 1.54 | −3.51 | 1.65 |
| 4000 | −4.14 | 1.55 | −3.02 | 1.67 |
| 6000 | −4.52 | 1.43 | −2.93 | 1.79 |
| 8000 | −5.27 | 1.41 | −1.94 | 1.90 |
| 10000 | −4.46 | 1.52 | −0.88 | Remarkable fog, very bad image quality |
| 12000 | −4.78 | 1.53 | | |
| 14000 | −4.03 | 1.68 | | |
| 16000 | −3.55 | 1.65 | | |
| 18000 | −4.01 | 1.59 | | |
| 20000 | −3.79 | 1.67 | | |
| 22000 | −3.23 | 1.69 | | |
| 24000 | −4.15 | 1.62 | | |
| 26000 | −4.43 | 1.58 | | |
| 28000 | −5.19 | 1.50 | | |
| 30000 | −5.05 | 1.53 | | |

MEASURING DEVICES AND METHODS (The same devices and methods were also used in the following Examples)

(1) Degree of Agglomeration

Degree of agglomeration is measured by a powder tester manufactured by Hosokawa Micromeritics Laboratory in the following way.

(a) Vessels having a 200 mesh filter, a 100 mesh filter and a 60 mesh filter, respectively, are piled on a vibrating system and fixed.

(b) 2g. of a toner is placed on the 60 mesh filter.

(c) Vibration is conducted for 40 min. at value a rheostat 4.0.

(d) Weights of toners remaining on the 200, 100 and 60 mesh filters are represented by $\omega_3$, $\omega_2$ and $\omega_1$.

$$\text{Degree of agglomeration} = \frac{1}{2}\left(\frac{\omega_3}{5} + \frac{3\omega_2}{5} + \omega_1\right) \times 100\%$$

(2) Triboelectric Charge (μc/g)

The triboelectric charge (μc/g) was measured in accordance with the following procedures.

(a) A small quantity of the toner was mixed with an appropriate quantity of iron powder as the carrier (EF 100–150 meshes) to prepare the developing agent. This developing agent was then placed in a measuring device and weighed together with the device.

(b) Then, this measuring instrument was connected to a volt-meter (manufactured by Takeda Riken K.K., Japan, Model TR-8651). After the measurement, the toner in the developing agent was removed by a cleaner at the bottom side of the measuring device. In the course of this cleaning action, the needle of the volt-meter oscillates. This oscillation of the needle was stopped at an appropriate point of the graduation, whereupon the measuring instrument is detached from the volt-meter to weigh the amount of the developing agent left on the balance. Thereafter, the value of the voltage already read from the measuring instrument is divided by the quantity of the toner reduced to obtain the value of voltage per gram of the toner. The quotient is multiplied by the capacitance value of a capacitor in the measuring instrument to obtain the triboelectric charge value T, as follows.

$$(v/9 \times 0.47\mu F = T\ \mu c/g)$$

(3) Image Density

Measured by a reflection densitometer.

In the following some examples of color toners are shown.

EXAMPLE 11

85 parts of polyester resin (XPL 2005S, trade name, Kao Atlas Co.), 150 parts of solid methyl silicone varnish (KR 220, trade name, Shinetsu Kagaku), and 7 parts of benzidine yellow organic pigment C.I. 21100 (Symuler Fast Yellow GRF, trade name, supplied by Dainihon Ink) were mixed and ground by a ball-mill, melted and kneaded by a roll-mill, cooled, roughly ground by a speed mill and then finely pulverized by a pulverizer of an air-jet type. The resulting finely divided powders were classified to select fine powders of 3–20 microns in size, and 15 parts of the fine powders thus selected was mixed with 85 parts of carrier iron powder (EFV 200/300, trade name, supplied by Nihon Teppun) to produce a developer. Copying was conducted with this developer by a dry electrophotographic copier using an ordinary paper (NP 1100, trade name, manufactured by Canon Kabushiki Kaisha) and there were obtained sharp yellow images free from fog. When 20,000 sheets of copy were continuously made, the image quality was not degraded. When the toner was stored for half a year at ambient temperature and humidity, the various characteristics did not degrade. Further, repeating the above procedure except that Pigment Red 122 (magenta pigment) and a blue organic pigment of C.I. 74160 were used in place of the benzidine yellow organic pigment, there were obtained a magenta toner and a cyan toner. When the three toners were overlapped, strong black images were obtained.

The composition and test results of Example 11 are shown in Tables 3–5.

EXAMPLES 12–28

The procedure of Example 11 was repeated except that the compositions in Table 3 were used in place of the composition of Example 11, and the test results are shown in Table 4.

COMPARISON EXAMPLES 3–8

The procedure of Example 11 was repeated except that the compositions in Table 3 were used in place of the composition of Example 11, and the results are shown in Table 4 and Table 5. When about 10,000 sheets of copy were continuously produced by using the resulting toners, fog increased and the degree of agglomeration also became large.

Table 3

Recipe for each of Examples and Comparative Examples (Parts by weight)

| | Polyester resin | | Solid silicone varnish | | Pigment | |
|---|---|---|---|---|---|---|
| Example 11 | XPL2005S | 85 | KR220 | 15 | C.I. 21100 | 7 |
| 12 | " | 85 | " | 15 | " | 4 |
| 13 | " | 85 | " | 15 | " | 10 |
| 14 | " | 95 | " | 5 | " | 7 |
| 15 | " | 90 | " | 10 | " | 7 |
| 16 | " | 75 | " | 25 | " | 7 |
| 17 | " | 50 | " | 50 | " | 7 |
| 18 | G 6570 | 90 | " | 10 | " | 7 |
| 19 | " | 75 | " | 25 | " | 7 |
| 20 | XPL2005S | 85 | " | 15 | C.I.21090 | 8 |
| 21 | " | 85 | " | 15 | " | 12 |
| 22 | " | 85 | " | 15 | " | 5 |
| 23 | G 6570 | 90 | " | 10 | " | 7 |
| 24 | " | 75 | " | 25 | " | 7 |
| 25 | XPL2005S | 85 | " | 15 | C.I.21095 | 8 |
| 26 | " | 85 | " | 15 | " | 13 |
| 27 | G 6570 | 95 | " | 5 | " | 7 |
| 28 | " | 70 | " | 30 | " | 8 |
| Comparative Example 3 | XPL2005S | 100 | | | C.I.21100 | 7 |
| 4 | G 6570 | 100 | | | " | 7 |
| 5 | XPL2005S | 100 | | | C.I.21090 | 7 |
| 6 | G 6570 | 100 | | | " | 7 |
| 7 | XPL2005S | 100 | | | C.I.21095 | 7 |
| 8 | G 6570 | 100 | | | " | 7 |

"XPL 2005S" (Softening point of 95–100° C., trade name, supplied by Kao Atlas Co.) and "G 6570" (Softening point of 100–110° C., trade name, supplied by Kao Atlas Co.) are prepared from bisphenol A and fumaric acid, and "KR 220" (trade name, supplied by Shinetsu Kagaku) is a solid methyl silicone varnish, and "KR 216" is a solid phenyl silicone varnish.

Table 4

| | Triboelectric charge μc/g | Color purity % | Degree of agglomeration |
|---|---|---|---|
| Example 11 | −4.51 | 83 | 22.3 |
| 12 | −6.22 | 80 | 21.2 |
| 13 | −4.03 | 82 | 22.9 |
| 14 | −4.76 | 79 | 32.4 |
| 15 | −4.82 | 80 | 27.6 |
| 16 | −4.59 | 83 | 20.0 |
| 17 | −5.04 | 84 | 18.2 |
| 18 | −6.12 | 80 | 31.8 |
| 19 | −5.54 | 81 | 23.3 |
| 20 | −4.23 | 82 | 20.2 |
| 21 | −3.53 | 81 | 21.5 |
| 22 | −5.44 | 81 | 20.8 |
| 23 | −5.63 | 79 | 26.4 |
| 24 | −6.29 | 80 | 19.7 |
| 25 | −5.65 | 80 | 23.4 |
| 26 | −4.21 | 81 | 22.9 |
| 27 | −6.24 | 78 | 37.3 |
| 28 | −5.77 | 79 | 19.0 |
| Comparative Example 3 | −5.56 | 80 | 79.5 |
| 4 | −6.74 | 77 | 85.6 |
| 5 | −2.42 | 80 | 80.4 |
| 6 | −4.45 | 78 | 88.0 |
| 7 | −6.78 | 79 | 78.1 |
| 8 | −8.29 | 75 | 90.2 |

The color purity was measured by a color-difference meter (manufactured by Nihon Denshoku K.K.).

Table 5

Durability tests for Developers in Example 11 and Comparative Example 3.

| Sheets of Copy | Example 11 Triboelectric charge μc/g | Example 11 Image density | Comparative Example 3 Triboelectric charge μc/g | Comparative Example 3 Image density |
|---|---|---|---|---|
| 1 | −4.51 | 1.52 | −5.56 | 1.41 |
| 1000 | −4.32 | 1.50 | −5.72 | 1.37 |
| 2000 | −4.10 | 1.55 | −5.39 | 1.29 |
| 3000 | −3.98 | 1.56 | −4.82 | 1.50 |
| 4000 | −4.27 | 1.48 | −4.71 | 1.44 |
| 5000 | −4.05 | 1.47 | −4.36 | 1.51 |
| 6000 | −3.93 | 1.62 | −4.01 | 1.43 |
| 7000 | −3.78 | 1.58 | −3.55 | 1.63 |
| 8000 | −4.29 | 1.51 | −3.23 | 1.69 |
| 9000 | −4.44 | 1.40 | −2.61 | 1.73 |
| 10000 | −4.02 | 1.52 | −1.21 | Fog Remarkable fog, degraded image quality |
| 11000 | −3.88 | 1.72 | | |
| 12000 | −3.56 | 1.58 | | |
| 13000 | −3.75 | 1.65 | | |
| 14000 | −4.11 | 1.42 | | |
| 15000 | −3.69 | 1.59 | | |
| 16000 | −3.42 | 1.67 | | |
| 17000 | −3.11 | 1.42 | | |
| 18000 | −3.50 | 1.38 | | |
| 19000 | −3.42 | 1.40 | | |
| 20000 | −3.61 | 1.59 | | |

EXAMPLE 29

85 parts of polyester resin (XPL 2005S, trade name, Kao Atlas Co.), 15 parts of solid methyl silicone varnish (KR 220, trade name, Shinetsu Kagaku), and 4 parts of Pigment Red 122 (Fastgen Super Magenta RS, trade name, Dainihon Ink) were mixed and ground by a ball-mill, melted and kneaded by a roll-mill, cooled, roughly ground by a speed mill and then finely pulverized by a pulverizer of an air-jet type. The resulting finely divided powders were classified to select the powders of 3–20 microns in size, and 15 parts of the powder thus selected and 85 parts of carrier powders (EFV 200/300, trade name, Nihon Teppun) were mixed to produce a developer.

The developer was used for copying by a dry electrophotographic copier using an ordinary paper (NP 1100, trade name, manufactured by Canon Kabushiki Kaisha) and sharp magenta color images were obtained. When 10,000 sheets of copy were continuously made, the image quality was not degraded. The toner was able to be stored for half a year at ambient temperature and humidity without deterioration of the various characteristics.

Further, the above procedure was repeated by using C.I. 21090 yellow organic pigment and C.I. 74160 blue organic pigment in place of the Pigment Red 122 to produce a yellow toner and a cyan toner, respectively. And the resulting three toners were overlaid to produce strong black images.

The composition and test results are shown in Table 6 - Table 8.

EXAMPLES 30 - 38

Repeating the procedure of Example 29 except that the compositions in Table 6 were used in place of the composition in Example 29, the results are shown in Table 7.

COMPARISON EXAMPLES 9 - 10

Repeating the procedure of Example 29 except that the compositions in Table 6 were used in place of the composition in Example 29, the results are shown in Tables 7 and 8.

When 6000 sheets of copy were continuously produced, fog increased and degree of agglomeration increased.

Table 6

(The unit is by weight)

| | Polyester resin | | Solid silicone varnish | | Pigment | |
|---|---|---|---|---|---|---|
| Example 29 | XPL2005S | 85 | KR220 | 15 | Pigment Red 122 | 4 |
| 30 | " | 85 | " | 15 | " | 2 |
| 31 | " | 85 | " | 15 | " | 8 |
| 32 | " | 95 | " | 5 | " | 4 |
| 33 | " | 50 | " | 50 | " | 4 |
| 34 | G 6570 | 80 | " | 20 | " | 4 |
| 35 | " | 80 | " | 20 | Pigment Red 81 | 5 |
| 36 | " | 90 | " | 10 | " | 3 |
| 37 | XPL2005S | 85 | " | 15 | " | 7 |
| 38 | " | 95 | " | 5 | " | 5 |
| Comparative Example 9 | XPL2005S 100 | | | | Pigment Red 122 | 4 |
| 10 | G 6570 | 100 | | | Pigment Red 81 | 5 |

Table 7

| | Triboelectric charge μc/g | Color purity % | Degree of agglomeration |
|---|---|---|---|
| Example 29 | −4.21 | 63.4 | 21.3 |
| 30 | −6.23 | 61.2 | 20.9 |
| 31 | −3.21 | 63.8 | 21.5 |
| 32 | −4.55 | 60.8 | 33.0 |
| 33 | −5.47 | 64.5 | 17.2 |
| 34 | −5.68 | 59.2 | 19.3 |
| 35 | −5.92 | 58.7 | 20.1 |
| 36 | −6.59 | 58.2 | 27.4 |
| 37 | −3.67 | 62.9 | 23.2 |
| 38 | −5.12 | 61.1 | 35.1 |
| Comparative Example 9 | −3.34 | 60.2 | 82.9 |
| 10 | −6.98 | 56.6 | 77.6 |

Table 8

Triboelectric charge and image density in Example 29 and Comparative Example 9 when the toners were continuously used.

| Sheets of Copy | Example 29 Triboelectric charge μc/g | Example 29 Image density | Comparative Example 9 Triboelectric charge μc/g | Comparative Example 9 Image density |
|---|---|---|---|---|
| 1 | −4.21 | 1.31 | −3.34 | −1.42 |
| 1000 | −4.53 | 1.33 | −4.12 | −1.37 |
| 2000 | −5.01 | 1.28 | −3.98 | −1.40 |
| 3000 | −4.87 | 1.29 | −3.54 | −1.41 |
| 4000 | −5.24 | 1.21 | −2.67 | −1.50 |
| 5000 | −4.72 | 1.30 | −1.78 | −1.62 |
| 6000 | −5.03 | 1.25 | −1.01 | Fog, remarkably degraded image quality |
| 7000 | −5.56 | 1.18 | | |
| 8000 | −5.11 | 1.19 | | |
| 9000 | −4.92 | 1.22 | | |
| 10000 | −5.33 | 1.17 | | |

EXAMPLE 39

87.5 parts of polyester resin (XPL 2005S, trade name, supplied by Kao Atlas Co.), 12.5 parts of solid silicone varnish (KR 220, trade name, manufactured by Shinetsu Kagaku) and 4.5 parts of phthalocyanine blue organic pigment, C.I. 74260 (Fastgen Blue 5007, trade name, manufactured by Dainihon Ink) were mixed and ground by a ball-mill, melted and kneaded by a roll-mill, cooled, roughly ground by a speed mill and finely pulverized by a pulverizer of an air-jey type. The resulting finely divided powders were classified to select powders of 3-20 microns in size. The powders (toner) thus selected (15 parts) and 85 parts of carrier iron powder (EFV 200/300, trade name, manufactured by Nihon Teppun) were mixed to produce a developer.

The resulting developer was used for copying by a dry electrophotographic copier using an ordinary paper (NP 1100, trade name, manufactured by Canon Kabushiki Kaisha) and there were obtained sharp blue images free from fog. Even then 10,000 sheets of copy were produced continuously, the image quality was not degraded.

The toner was stored for half a year at ambient temperature and humidity without any deterioration of the various characteristics.

Repeating the above procedure except that Pigment Red 122 and a yellow organic pigment of C.I. 21090 were used in place of the phthalocyanine blue organic pigment, there were obtained a magenta toner and a yellow toner, respectively. When these three toners were overlaid, strong black images were obtained.

The composition and test results are shown in Tables 9-11.

EXAMPLES 40-48

Repeating the procedure of Example 39 except that the compositions as shown in Table 9 were used in place of the composition of Example 39, the results are shown in Table 10.

COMPARATIVE EXAMPLES 11-12

Repeating the procedure of Example 39 except that the compositions in Table 9 were used in place of the composition of Example 39, the results are shown in Tables 10-11.

When the toners were used for reproducing 5000 sheets of copy, fog increased and degree of agglomeration also increased.

Table 9

(The unit is by weight)

| | Polyester resin | | Solid silicone varnish | | Pigment | |
|---|---|---|---|---|---|---|
| Example 39 | XPL2005S | 87.5 | KR220 | 12.5 | C.I.74260 | 4.5 |
| 40 | " | 87.5 | " | 12.5 | " | 2 |
| 41 | " | 87.5 | " | 12.5 | " | 8 |
| 42 | " | 95 | " | 5 | "/4 | |
| 43 | " | 50 | " | 50 | " | 4 |
| 44 | G 6570 | 85 | " | 15 | " | 4 |
| 45 | " | 85 | " | 15 | C.I.74280 | 5 |
| 46 | " | 75 | " | 25 | " | 10 |
| 47 | XPL2005S | 90 | " | 10 | " | 5 |
| 48 | " | 75 | " | 25 | " | 5 |
| Comparative Example 11 | XPL2005S | 100 | | | C.I.74260 | 4.5 |
| 12 | G 6570 | 100 | | | C.I.74280 | 5 |

Table 10

| | Triboelectric charge μc/g | Color purity % | Degree of agglomeration |
|---|---|---|---|
| Example 39 | −4.50 | 61.4 | 15.5 |
| 40 | −5.98 | 60.2 | 16.3 |
| 41 | −3.87 | 62.5 | 17.2 |
| 42 | −4.21 | 60.1 | 32.1 |
| 43 | −5.03 | 63.3 | 13.2 |
| 44 | −6.12 | 59.4 | 17.3 |
| 45 | −5.94 | 58.8 | 16.4 |
| 46 | −5.34 | 60.5 | 15.1 |
| 47 | −4.41 | 61.2 | 20.2 |

Table 10-continued

| | Triboelectric charge μc/g | Color purity % | Degree of agglomeration |
|---|---|---|---|
| 48 | −4.77 | 62.0 | 15.0 |
| Comparative Example 11 | −4.92 | 60.3 | 86.8 |
| 12 | −7.99 | 57.0 | 72.4 |

Table 11

Triboelectric charge and image density in Example 239 and Comparative Example 11 when the toners were continuously used.

| Sheets of Copy | Example 39 Triboelectric charge μc/g | Example 39 Image density | Comparative Example 11 Triboelectric charge μc/g | Comparative Example 11 Image density |
|---|---|---|---|---|
| 1 | −4.50 | 1.32 | −4.92 | 1.40 |
| 1000 | −4.41 | 1.29 | −4.56 | 1.42 |
| 2000 | −4.92 | 1.25 | −4.00 | 1.35 |
| 3000 | −4.52 | 1.31 | −3.52 | 1.45 |
| 4000 | −4.76 | 1.37 | −2.43 | 1.51 (Some fog) |
| 5000 | −5.53 | 1.35 | −1.56 | Fog, not sharp image |
| 6000 | −5.14 | 1.41 | | |
| 7000 | −4.49 | 1.40 | | |
| 8000 | −4.88 | 1.34 | | |
| 9000 | −4.77 | 1.28 | | |
| 10000 | −5.01 | 1.26 | | |

We claim

1. In a toner for developing electrostatic latent images comprising a colorant in a resin binder the improvement which comprises a resin binder comprising a polyester resin having a softening point of 80–150° C. according to the Ring and Ball method and a solid silicone varnish having a molecular weight of 500–2000, wherein at least one part by weight of said solid silicone varnish is employed per 100 parts by weight of said polyester resin.

2. A toner according to claim 1, containing 2–100 parts by weight of the solid silicone varnish per 100 parts by weight of the polyester resin.

3. A toner according to claim 1 in which the solid silicone varnish is selected from the group consisting of methyl silicone varnish, phenyl silicone varnish and methyl phenyl silicone varnish.

4. A toner according to claim 1 in which said colorant is a benzidine yellow organic pigment and is dispersed in the resin binder.

5. A toner according to claim 4 containing 2–15 parts by weight of the benzidine yellow organic pigment per 100 parts by weight of the resin binder.

6. A toner according to claim 4 in which the benzidine yellow organic pigment is selected from the group consisting of pigmens of Color Index Nos. 21090, 21095 and 21100.

7. A toner according to claim 1 in which said colorant is a magenta organic pigment selected from the group consisting of magenta organic pigments of the quinacridone series and magenta organic pigments of the rhodamine series, and is dispersed in the resin binder.

8. A toner according to claim 7 containing 2–10 parts by weight of the magenta organic pigment per 100 parts by weight of the resin binder.

9. A toner according to claim 7 in which the magenta organic pigment is selected from the group consisting of pigments of Color Index No. Pigment Red 122 and Color Index No. Pigment Red 81.

10. A toner according to claim 1 in which said colorant is a cyan organic pigment of the phthalocyanine series and is dispersed in the resin binder.

11. A toner according to claim 10 containing 1–10 parts by weight of the cyan organic pigment per 100 parts by weight of the resin binder.

12. A toner according to claim 10 in which the cyan organic pigment is selected from the group consisting of pigments of Color Index Nos. 74100, 74250, 74260, 74280, 74255, 74160 and 74180.

13. A toner according to claim 1 wherein said polyester resin is prepared from a diol and a dicarboxylic acid, or derivatives thereof.

14. A toner according to claim 1 wherein said polyester resin is a member selected from the group consisting of polyester resins prepared by reacting (1) bisphenol A and fumaric acid, (2) propylene glycol and fumaric acid, (3) neopentyl glycol and fumaric acid, (4) propylene glycol and maleic anhydride and phthalic anhydride, (5) propylene glycol and maleic anhydride, (6) neopentyl glycol and fumaric acid, (7) propylene glycol, neopentyl glycol and fumaric acid, and (8) propylene glycol, neopentyl glycol, fumaric acid and phthalic anhydride.

15. A toner according to claim 1 wherein the softening point of said solid silicone varnish is from 55–150° C.

16. A toner according to claim 1 wherein the softening point of said solid silicone varnish is from 60–100° C.

17. A toner according to claim 1 containing 4–100 parts by weight of the solid silicone varnish per 100 parts by weight of the polyester resin.

18. A toner according to claim 1 containing from 1–20 parts by weight of said colorant per 100 parts by weight of said resin binder.

19. A toner according to claim 1 wherein the particle size of said toner is from 1–50 microns.

* * * * *

UNITED STATES PATENT AND TRADEMARK OFFICE

CERTIFICATE OF CORRECTION

PATENT NO. : 4,142,982

DATED : March 6, 1979

INVENTOR(S) : Hiroshi Yamakami et al

It is certified that error appears in the above-identified patent and that said Letters Patent are hereby corrected as shown below:

Column 7, lines 55-56, "at value a rheostat 4.0" should read --at a rheostat value of 4.0--

Column 11, please change the last five horizontal lines of Table 6 to read as follows:

| | | | | | | | |
|---|---|---|---|---|---|---|---|
| Comparative Example | 9 | XPL2005S | 100 | - | - | Pigment Red 122 | 4 |
| | 10 | G 6570 | 100 | - | - | Pigment Red 81 | 5 |

Column 12, line 13, "then" should read --when--.

Column 12, line 49, in Table 9, the next to last vertical column, the fourth horizontal line in the table, delete the expression " "/4 " and insert in the next to last and last columns, respectively, the entries -- " -- and -- 4 --.

UNITED STATES PATENT AND TRADEMARK OFFICE

CERTIFICATE OF CORRECTION

PATENT NO. : 4,142,982

DATED : March 6, 1979

INVENTOR(S) : Hiroshi Yamakami et al

It is certified that error appears in the above-identified patent and that said Letters Patent are hereby corrected as shown below:

Column 13, in the second line in the heading of Table 11 at about line 11, change "Example 239" to read -- Example 39 --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*